US007429698B2

(12) United States Patent
Pickens

(10) Patent No.: US 7,429,698 B2
(45) Date of Patent: Sep. 30, 2008

(54) ACOUSTIC PRACTICE PERCUSSION INSTRUMENT AND PRACTICE KIT

(75) Inventor: Keith A. Pickens, Walland, TN (US)

(73) Assignee: Kieffa Drums, LLC, Knoxville, TN (US)

( * ) Notice: Subject to any disclaimer, the term of this patent is extended or adjusted under 35 U.S.C. 154(b) by 0 days.

(21) Appl. No.: 11/676,363

(22) Filed: Feb. 19, 2007

(65) Prior Publication Data

US 2007/0169610 A1 Jul. 26, 2007

Related U.S. Application Data

(63) Continuation-in-part of application No. 10/907,713, filed on Apr. 13, 2005, now Pat. No. 7,179,985.

(51) Int. Cl.

| | |
|---|---|
| ***G10D 13/02*** | (2006.01) |
| ***G10H 3/00*** | (2006.01) |
| ***G10H 3/14*** | (2006.01) |
| ***G10H 1/02*** | (2006.01) |
| ***G10H 1/32*** | (2006.01) |

(52) U.S. Cl. ..... 84/411 R; 84/414; 84/416; 84/723; 84/725; 84/738; 84/743

(58) Field of Classification Search ..... 84/411 R, 84/743, 725, 723, 416, 414, 738
See application file for complete search history.

(56) References Cited

U.S. PATENT DOCUMENTS

| | | | | | |
|---|---|---|---|---|---|
| 3,757,027 | A | * | 9/1973 | Morena et al. | 84/416 |
| 3,956,959 | A | * | 5/1976 | Ebihara et al. | 84/725 |
| 4,168,646 | A | * | 9/1979 | May | 84/723 |
| 4,201,107 | A | * | 5/1980 | Barber et al. | 84/743 |
| 4,214,504 | A | * | 7/1980 | Rex | 84/411 R |
| 4,281,221 | A | * | 7/1981 | DelBello | 381/121 |
| 4,479,412 | A | * | 10/1984 | Klynas | 84/730 |
| 4,570,522 | A | * | 2/1986 | May | 84/723 |
| 4,660,455 | A | * | 4/1987 | Jones et al. | 84/413 |
| 5,042,356 | A | * | 8/1991 | Karch | 84/725 |
| 5,293,000 | A | * | 3/1994 | Adinolfi | 84/730 |
| 5,323,678 | A | * | 6/1994 | Yould | 84/418 |
| 5,579,397 | A | * | 11/1996 | Ikeda et al. | 381/113 |
| 5,583,307 | A | * | 12/1996 | Tobia, Jr. | 84/411 R |
| 5,585,581 | A | * | 12/1996 | Rogers | 84/414 |

(Continued)

FOREIGN PATENT DOCUMENTS

| | | |
|---|---|---|
| CA | 2209970 C | 1/1998 |

(Continued)

*Primary Examiner*—Lincoln Donovan
*Assistant Examiner*—Christina Russell
(74) *Attorney, Agent, or Firm*—Luedeka, Neely & Graham, PC

(57) ABSTRACT

An acoustic percussion instrument and percussion set containing the instrument. The instrument includes a hollow cylindrical shell having a first end and a second end and an inside cylindrical surface. A first substantially rigid plate having an outside surface and an inside surface is attached adjacent to the first end of the hollow cylindrical shell. A first resilient pad, that provides a percussion surface that does not require periodic adjustment, is attached adjacent to the outside surface of the first substantially rigid plate. A raised rim circumscribes the first resilient pad.

29 Claims, 5 Drawing Sheets

U.S. PATENT DOCUMENTS

| | | | | |
|---|---|---|---|---|
| 5,602,354 | A * | 2/1997 | Martin | 84/410 |
| 5,811,709 | A * | 9/1998 | Adinolfi | 84/723 |
| 5,856,628 | A * | 1/1999 | Noguchi et al. | 84/738 |
| 5,929,354 | A * | 7/1999 | Davis | 84/411 P |
| 5,977,473 | A * | 11/1999 | Adinolfi | 84/723 |
| 6,057,499 | A * | 5/2000 | Basmadjian | 84/411 R |
| 6,121,528 | A * | 9/2000 | May | 84/411 R |
| 6,211,448 | B1 * | 4/2001 | Shigenaga et al. | 84/411 R |
| 6,239,340 | B1 * | 5/2001 | Heuerman | 84/411 P |
| 6,700,044 | B1 * | 3/2004 | Bencomo, Jr. | 84/411 R |
| 7,179,985 | B2 * | 2/2007 | Pickens | 84/743 |
| 7,256,342 | B2 * | 8/2007 | Hagiwara et al. | 84/726 |
| 2002/0096035 | A1 * | 7/2002 | Good | 84/414 |
| 2002/0184992 | A1 * | 12/2002 | Brando | 84/411 R |
| 2003/0037660 | A1 * | 2/2003 | Suenaga | 84/411 R |
| 2003/0221545 | A1 * | 12/2003 | Tomoda | 84/723 |
| 2005/0188816 | A1 * | 9/2005 | May | 84/411 R |
| 2006/0060061 | A1 * | 3/2006 | Henry | 84/413 |
| 2006/0272490 | A1 * | 12/2006 | May | 84/743 |

FOREIGN PATENT DOCUMENTS

| | | |
|---|---|---|
| GB | 2335779 A | 9/1999 |
| JP | 1246597 | 10/1989 |

* cited by examiner

ACOUSTIC PRACTICE PERCUSSION INSTRUMENT AND PRACTICE KIT

RELATED APPLICATIONS

This application is a continuation-in-part of U.S. Pat. No. 7,179,985, entitled "Hybrid Electric/Acoustic Percussion Instrument," issued Feb. 20, 2007.

TECHNICAL FIELD

The disclosure relates to improved percussion instruments and in particular to acoustic percussion instruments such as drums and cymbals that are specifically adapted for practice purposes and provide realistic feel.

BACKGROUND AND SUMMARY

Percussion instruments such as drums and cymbals have been made and used for many years to produce pleasing sounds. However, conventional drums require a stretched membrane attached to a hollow cylinder to produce rhythm sounds. The membrane may require periodic readjustment to provide the correct tones. Such drums are often rather large and cumbersome to transport.

Attempts have been made to increase the volume output of an acoustical drum without increasing the size of the drum by placing microphones adjacent to the drums. Microphone placement depends on a number of factors including room dimensions and the directional aspects of the microphone relative to the drum head. Accordingly, a user may have to readjust the microphone periodically for a particular location. Furthermore, only the vibratory sound of the drumhead is amplified by such microphone placement without much amplification of the resonant components of the sound. Placing the microphone inside a conventional drum provides amplification of a mixture of vibratory sounds that are not pleasingly acceptable to a hearing audience.

As electronics have become more sophisticated, synthesizers have been developed to simulate the sound of conventional percussion instruments such as drums and cymbals. However, such electronic percussion instruments require a computer and software to convert sounds produced by striking a surface into pleasing sounds similar to those obtained by conventional drums and cymbals. Typically, such synthesizers do not include acoustic components.

Despite advances made in the improvements in percussion instruments, there continues to be a need for simple, percussion instruments having realistic feel and acoustic sound and are adaptable for electronic amplification.

With regard to the foregoing, the disclosure provides an acoustic percussion instrument. The instrument includes a hollow cylindrical shell having a first end and a second end and an inside cylindrical surface. A first substantially rigid plate having an outside surface and an inside surface is attached adjacent to the first end of the hollow cylindrical shell. A first resilient pad, providing a percussion surface that does not require periodic adjustment, is attached to the outside surface of the first substantially rigid plate. A raised resilient rim circumscribes the first resilient pad.

In another embodiment there is provided a acoustic percussion instrument. The dual-headed percussion instrument includes a hollow cylindrical shell having a first end and a second end and an inside cylindrical surface. A first substantially rigid plate having an outside surface and an inside surface is attached adjacent to the first end of the hollow cylindrical shell. A second substantially rigid plate having an inside surface and an outside surface is attached adjacent to the second end of the hollow cylindrical shell. The second substantially rigid plate is thicker than the first substantially rigid plate. A first resilient pad, providing a first percussion surface that does not require periodic adjustment, is attached adjacent to the outside surface of the first substantially rigid plate. A second resilient pad, providing a second percussion surface that does not require periodic adjustment, is attached adjacent to the outside surface of the second substantially rigid plate. A snare simulation element is attached to the inside surface of one or the first or second substantially rigid plates. A raised resilient rim circumscribes at least one the first and second resilient pads.

A further exemplary embodiment of the disclosure provides a percussion instrument practice kit. The kit includes a practice pad and sheet music structure having at least one practice pad disposed in a cavity of an enclosure and a cover hingedly attached to the enclosure. The practice pad has a first hollow shell having a first end and a second end and an inside surface. A first substantially rigid plate having an outside surface and an inside surface is attached adjacent to the first end of the first hollow shell. A first resilient pad providing a percussion surface that does not require periodic adjustment is attached adjacent to the outside surface of the first substantially rigid plate. The cover includes a holder for attaching sheet music thereto.

An advantage of the percussion instruments according to the disclosure is the relative simplicity of design. Unlike a conventional drum, there is no thin membrane that requires tensioning or readjustment in order to produce the desired sound. In the disclosed percussion instruments, the resilient pad is fixedly attached to the substantially rigid plate giving the percussion instrument a "pre-tuned" and "pre-tightened" surface that does not require periodic adjustment.

Variation in the substantially rigid plate thickness and size, coupled with the diameter and length dimension of the hollow cylindrical shell and/or with the snare simulation element, provides a characteristic tone and timbre for the percussion instrument. Another advantage is that a different tone and timbre may be produced from a single instrument by altering the components used to construct the instrument.

The practice kit provides versatility with regard to the rehearsal needs of a percussionist. The kit enables improved portability of the practice pad along with a structure for displaying sheet music and for storing percussion sticks used in practice.

BRIEF DESCRIPTION OF THE DRAWINGS

Further features and advantages of exemplary embodiments disclosed herein may become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
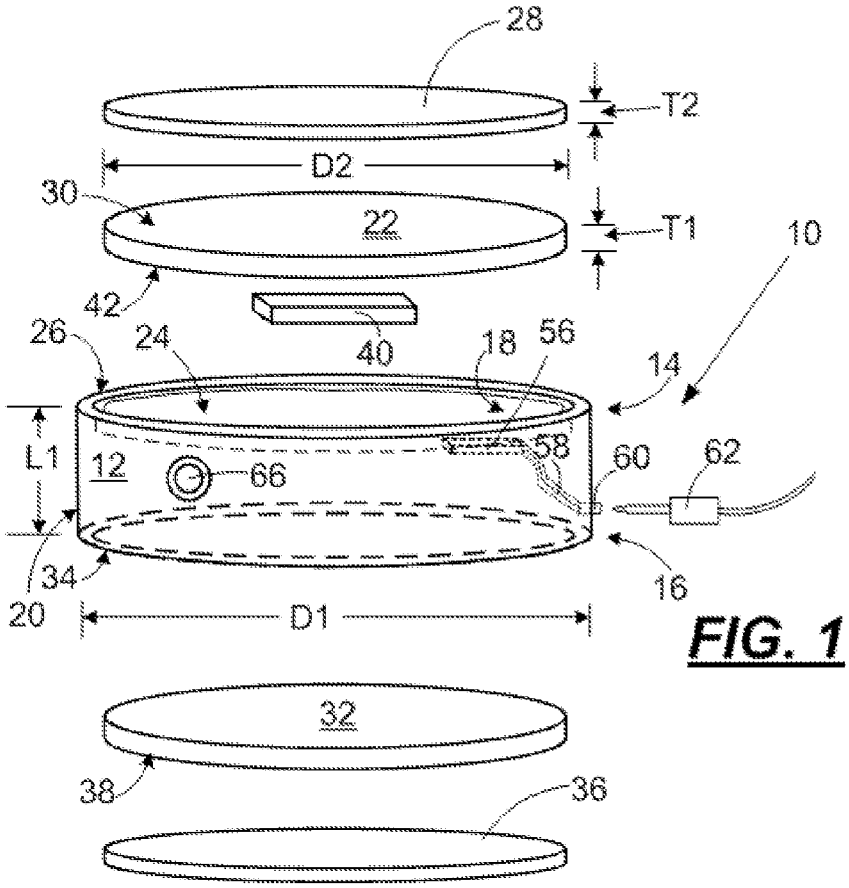
FIG. 1 is an exploded perspective view, not to scale, of a percussion instrument according to the disclosure.

With reference to FIG. 1, there is illustrated in an exploded view, an acoustic percussion instrument 10 according to an exemplary embodiment of the disclosure. The instrument 10 includes a hollow cylindrical shell 12 having a first end 14, a second end 16, and an inside cylindrical surface 18. The shell 12 may be made of a variety of resonance producing materials including, but not limited to wood, fiberglass, thermoplastics, metals, and composite materials made from two or more of the foregoing materials. A suitable material for the shell 12 is a solid wooden material or laminated wooden material which may include two or more wood plies adhesively joined together. A particularly suitable material for the shell 12 is a laminated plywood shell having from about six to about ten plies providing a shell wall thickness ranging from about 0.5 to about 1.5 centimeters. A decorative ply made of birch, mahogany, or maple veneer may be applied to an outer shell wall 20.

While a cylindrical shell 12 is illustrated, the disclosure is not limited to cylindrical shells as rectangular shells may also provide the advantages of the disclosed embodiments. However, for the purpose of simplicity, a percussion instrument having a cylindrical shell will now be described.

Shell sizes may vary according to the desired tone. Representative length L1 and diameter D1 of shells 12 which may be used to provide percussion instruments according to the disclosure are provided in the following table.

TABLE 1

| Instrument | Diameter (D1) (cm) | Length (L1)(cm) |
|---|---|---|
| Piccolo snare | 10 to 16 | 20.5 |
| Soprano snare | 7 to 10 | 25.5 |
| Alto snare | 10 to 15 | 30.5 |
| Tenor | 16.5 to 20 | 33 |
| Marching snare | 15 to 21.5 | 33 |
| Multi tenor | 10 to 30.5 | 33 |
| Marching Tenor | 15 to 21.5 | 33 |
| Marching bass | 45 to 51 | 51 |

A first substantially rigid plate 22 is affixed adjacent to the first end 14 of the shell 12 so that the plate 22 is disposed in a cavity 24 of the shell 12. The substantially rigid plate 22 may be made of a variety of materials including wood, plastic, fiberglass, metal and the like. A particularly suitable material for the substantially rigid plate 22 is wood, which may be solid wood or desirably a laminated wood material having from about 2 to about 10 plies and having a thickness T1 ranging from about 0.3 to about 3.0 centimeters. Representative thicknesses T1 and diameters D2 of the substantially rigid plate 22 are giving in the following table for providing the instruments indicated.

TABLE 2

| Instrument | Diameter (D2) (cm) | Thickness (T1)(cm) |
|---|---|---|
| Piccolo snare | 10 to 16 | 0.3 to 2.0 |
| Soprano snare | 7 to 10 | 0.3 to 2.0 |
| Alto snare | 10 to 15 | 0.3 to 2.0 |
| Tenor | 16.5 to 20 | 0.3 to 2.0 |

TABLE 2-continued

| Instrument | Diameter (D2) (cm) | Thickness (T1)(cm) |
|---|---|---|
| Marching snare | 15 to 21.5 | 1.2 to 2.6 |
| Multi tenor | 10 to 30.5 | 0.6 to 1.3 |
| Marching Tenor | 15 to 21.5 | 0.6 to 1.3 |
| Marching bass | 45 to 51 | 1.3 to 2.6 |

The substantially rigid plate 22 may be glued or otherwise affixed to the inside cylindrical surface 18 of the shell 12 so that the plate 22 is recessed within the shell 12 to provide a raised rim 26 circumscribing the plate 22. A resilient pad 28 is attached adjacent to an outside surface 30 of the substantially rigid plate 22. The rim 26 may include a material selected from natural and synthetic rubbers, polyvinylchloride, and metal to provide an additional percussion surface. Sound may be produced by striking the pad 28 and/or the rim 26.

The resilient pad 28 is selected from materials that are suitable for providing the percussion instrument 10 with the bounce and tone of a conventional drum head without having to manually tune, tighten, or replace the drum head as with conventional drum heads. Resilient pads 28 may be provided by natural or synthetic elastomeric materials having a durometer ranging from about 30 to about 50. A thickness T2 of the resilient pad 28 may also be selected to provide bounce characteristics and feel when struck similar to the bounce characteristics and feel provided by striking a conventional drum. Accordingly, the thickness T2 of the resilient pad 28 may range from about 0.1 to about 2.5 centimeters. Representative resilient pad thicknesses T2 for instruments are given in the following table.

TABLE 3

| Instrument | Diameter (D2) (cm) | Thickness (T2)(cm) |
|---|---|---|
| Piccolo snare | 10 to 16 | 0.1 to 0.6 |
| Soprano snare | 7 to 10 | 0.1 to 0.6 |
| Alto snare | 10 to 15 | 0.3 to 0.6 |
| Tenor | 16.5 to 20 | 0.3 to 1.3 |
| Marching snare | 15 to 21.5 | 0.1 to 0.6 |
| Multi tenor | 10 to 30.5 | 0.1 to 0.6 |
| Marching Tenor | 15 to 21.5 | 0.3 to 1.3 |
| Marching bass | 45 to 51 | 0.6 to 2.6 |

A particularly preferred resilient pad 28 is a full floating natural gum rubber having a durometer of about 40, a minimum tensile strength of about 3000 psi, a minimum elongation of about 600% and a smooth finish.

In another embodiment of the disclosure, a second substantially rigid plate 32 attached adjacent to the second end 16 of the cylindrical shell 12. As with the first substantially rigid plate 22, the second substantially rigid plate 32 may also be recessed in the shell 12 to provide a second raised rim 34. In another embodiment, a second resilient pad 36 may be affixed adjacent to an outside surface 38 of the second rigid plate 32. The second substantially rigid plate 32 and/or pad 36 may have the same thicknesses T1 and T2 and same Diameter D2 as the first substantially rigid plate 22 and pad 28. In an alternative embodiment, the second substantially rigid plate 32 and/or pad 36 may have different thicknesses from the first substantially rigid plate 22 and pad 28 thereby providing a different tone for an opposing side of the instrument 10. Dimensions for each of the first and second substantially rigid plates 22 and 32 and pads 28 and 36 may be selected from the above tables 2 and 3.

Figure 2:
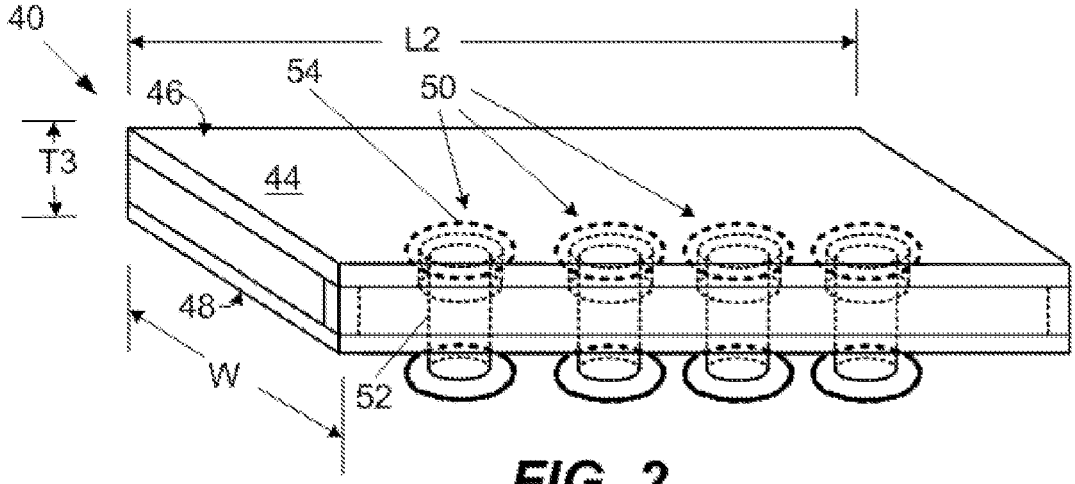
FIG. 2 is an enlarged perspective view, not to scale, of a snare simulation element for a percussion instrument according to the disclosure.

The percussion instrument may also include a snare simulation element 40 attached to an inside surface 42 of the first substantially rigid plate 22. An enlarged illustration of a snare simulation element 40 is provided in FIG. 2. The snare simulation element 40 includes a hollow metal tube 44 having a first surface 46, a second surface 48 opposite the first surface 46, and plurality of sound producing components 50 loosely attached to the tube 44 or disposed in the tube 44. Accordingly, the sound producing components 50 may be a plurality of rivets 52 as shown attached in apertures 54 through the second surface 48 of the tube 44, or may be metal pellets disposed in the hollow metal tube 44 generally as described in U.S. Pat. No. 6,239,340, the disclosure of which is incorporated herein by reference. The hollow metal tube 44 may have a variety of shapes including cylindrical, polyhedron and the like. Alternatively, the rivets 52 may be loosely attached to a thin metal strip that is attached to the inside surface 42 of the plate 22. The first surface 46 of the snare simulation element 40 may be adhesively attached to the inside surface 42 of the first substantially rigid plate 22, or may be attached to the inside surface 42 by a variety of conventional fastening techniques so that the sound producing components 52 freely move with respect to the hollow metal tube 44 or metal strip.

An exemplary snare simulation element 40 may be made from a hollow rectangular aluminum tube having an overall dimension T3 ranging from about 0.6 to about 1.3 centimeters, a width W ranging from about 1.3 to about 5.2 centimeters and a length L2 ranging from about 7 to about 15 centimeters. The thickness of metal for the hollow metal tube 44 is not particularly critical to the disclosed embodiments. The hollow metal tube 44 may include from about 1 to about 10 rivets 52 loosely disposed in the apertures 54 formed in through second surface 46 of the tube 40. Each of the rivets 52 may be the same or may be different from each other is size. In other alternate embodiments, the snare simulation element 40 may be attached to the first substantially rigid plate 22, the second substantially rigid plate 32, or to both the first and second substantially rigid plates 22 and 32.

In order to provide simulated percussion sounds, a pressure transducer 56 may be attached to the inside surface 42 of the first rigid plate 22. The transducer 56 may be affixed to the inside surface 42 by a variety of techniques known to those skilled in the art.

The transducer 56 may be electrically connected as by wires 58 to a coax-style DC power jack 60 that is attached to the shell 12. An electrical lead 62 may be plugged into the power jack 60 to electrically connect the transducer 56 to a sound simulation unit 64. Accordingly, the percussion instrument 10 may be used with or without the sound simulation unit 64 to provide acoustic and/or simulated sounds. The shell 12 may also include one or more vent holes 66.

Figure 3:
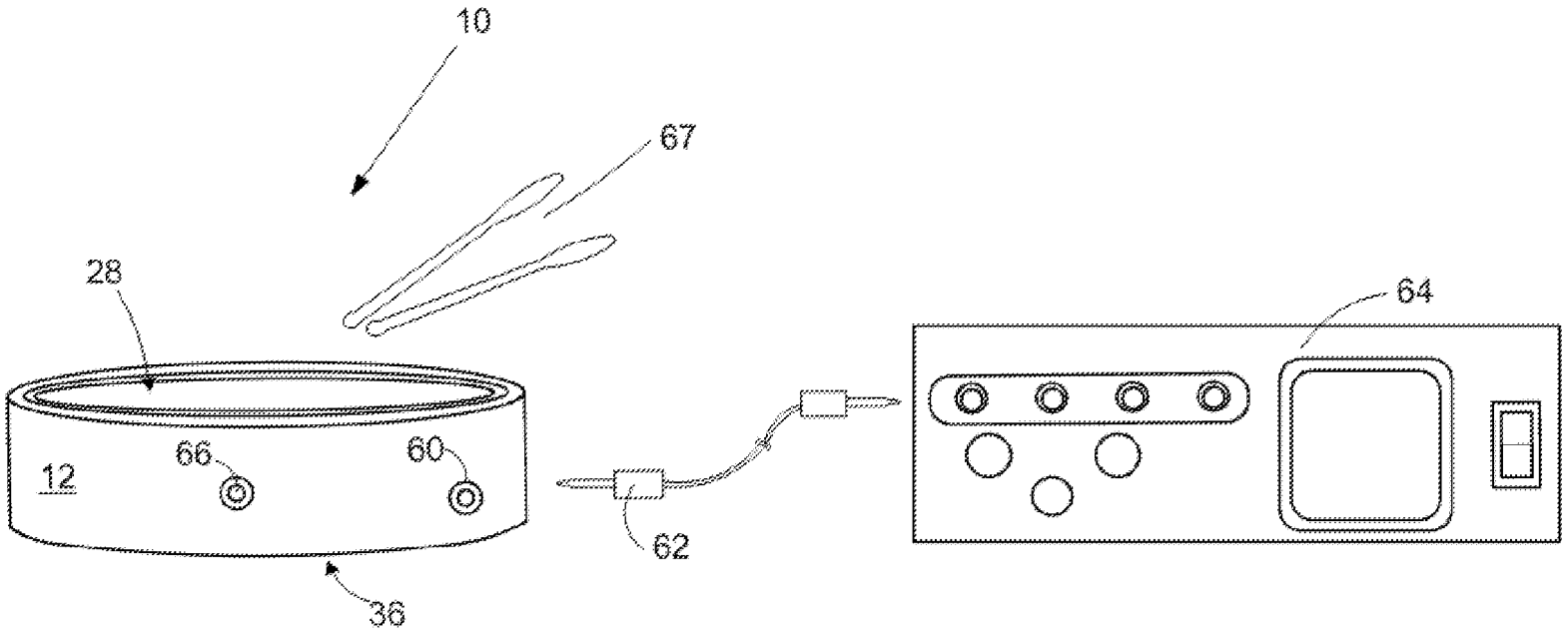
FIG. 3 is an illustration, not to scale, of a percussion instrument according to the disclosure for connection to a sound simulation unit.

An assembled instrument 10 is illustrated in FIG. 3. Conventional drum sticks 67 may be used to beat the resilient pads 28 and/or 36 to provide an acoustic and/or simulated percussion sound. When the instrument 10 is attached as by electrical lead 62 to a sound simulation unit 64, a variety of sounds can be produced by selecting a desired sound output using the sound simulation unit 64. As set forth above, however, the percussion instrument 10 may be used without electrical connection to an amplifier or sound simulation yet provide pleasing tones due to the construction of the pad 28, plate 22 and cylindrical shell 12.

Figure 4:
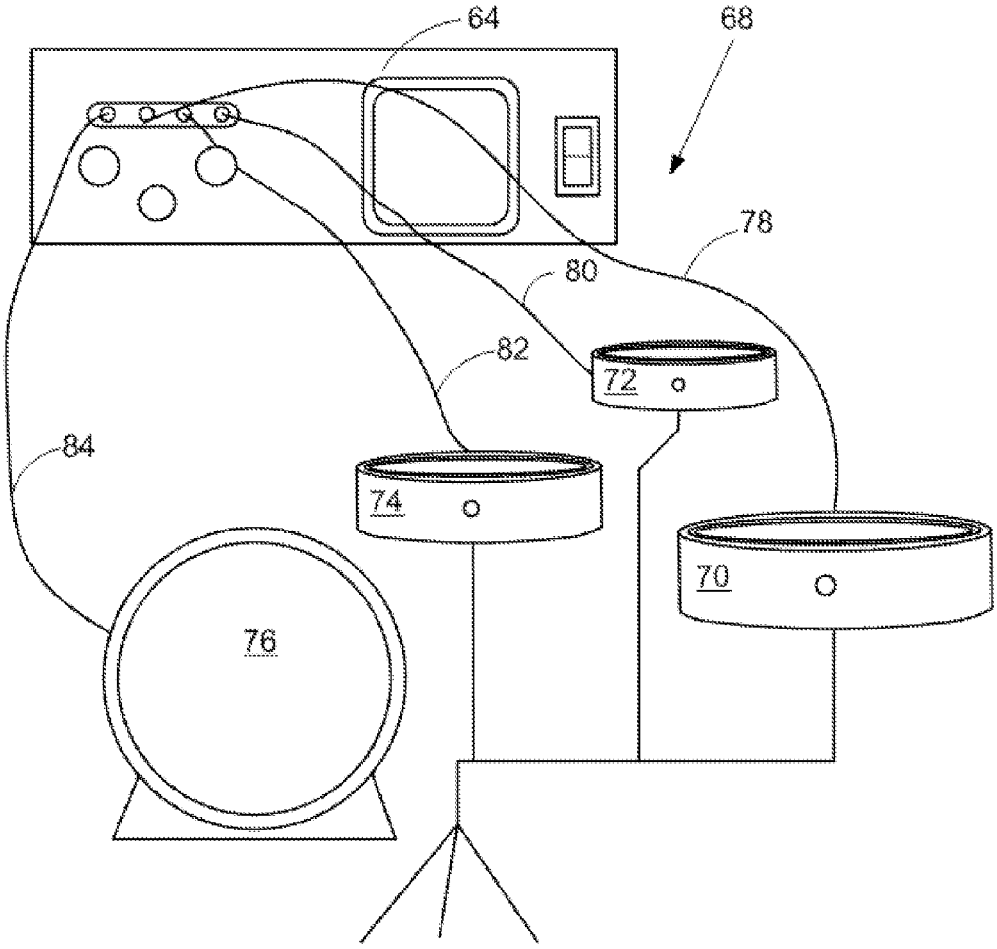
FIG. 4 is an illustration, not to scale, of a percussion instrument set connected to a sound simulation until.

As shown in FIG. 4, embodiments of the disclosure may also include a percussion instrument system 68. The system may include first, second, third, and fourth percussion instruments 70, 72, 74, and 76 of different sizes to provide different sounds. Each of the percussion instruments 70-76 may, alternatively include the transducer 56 for providing simulated sounds. In the case of the instruments 70-76 including transducers 56, leads 78, 80, 82, and 84 are provided for connecting each of the percussion instruments 70-76 to the simulation unit 64. One or more of the instruments 70-76 may also include the snare simulation element 40 described above.

The percussion instruments 10 may provide different timbres, and notes/pitches depending on various factors. The term "timbre" refers to the overall character of the percussion instrument, i.e., the distinct quality of the sound given by the instrument's overtones. The fact that one percussion instrument is "bright" vs. "dark" is the timbre. The "fundamental" note, which is the point at which the percussion instrument is likely to be most "open" or "resonant" in tone quality, it's the sweet spot for that particular percussion instrument's shell 12. The shell 12 design is a governing factor for the percussion instrument note.

"Pitch" is the highness or lowness of the sound the percussion instrument produces. The pitch can be raised or lowered in reference to say a note on the piano, and it is the act of tuning. But the shell sweet spot or fundamental note at which the shell resonates doesn't change. So a 12" percussion instrument of a given material, diameter and depth may produce a note of G up to a D-sharp ("pitch"), but it may really stand out around an A-flat ("fundamental"), or the note of shell. The fact that it becomes bass heavy ("dark") or very treble heavy ("bright") is the timbre.

Tone color enables one to distinguish between two sources producing a sustained sound at the same pitch. Every sound whether it's pitched or non-pitched has a certain tonal character called timbre. Strictly speaking timbre is an element of sound that enables one to determine the difference between two instruments playing the same melody. In addition to the basic note heard as the pitch of a musical sound, there are a whole range of frequencies that we call partials related to that note that give it a unique tone color. The tone color or timbre is provided by different size percussion instruments playing a single note or by a position on the pad 28 distant from the rim 26 that is struck by a user. Non-pitched sounds like drums typically have non-harmonic partials. Any sound has a unique spectrum, i.e., a set of overtones or partials that causes it to have a unique timbre.

It will be appreciated that each of the instruments according to the disclosure may provide a variety of sounds by striking the pads 28 either closer to the rim 26 or further from the rim 26. Additionally, the rim 26 may be struck to provide a desirable sound.

Figure 5:
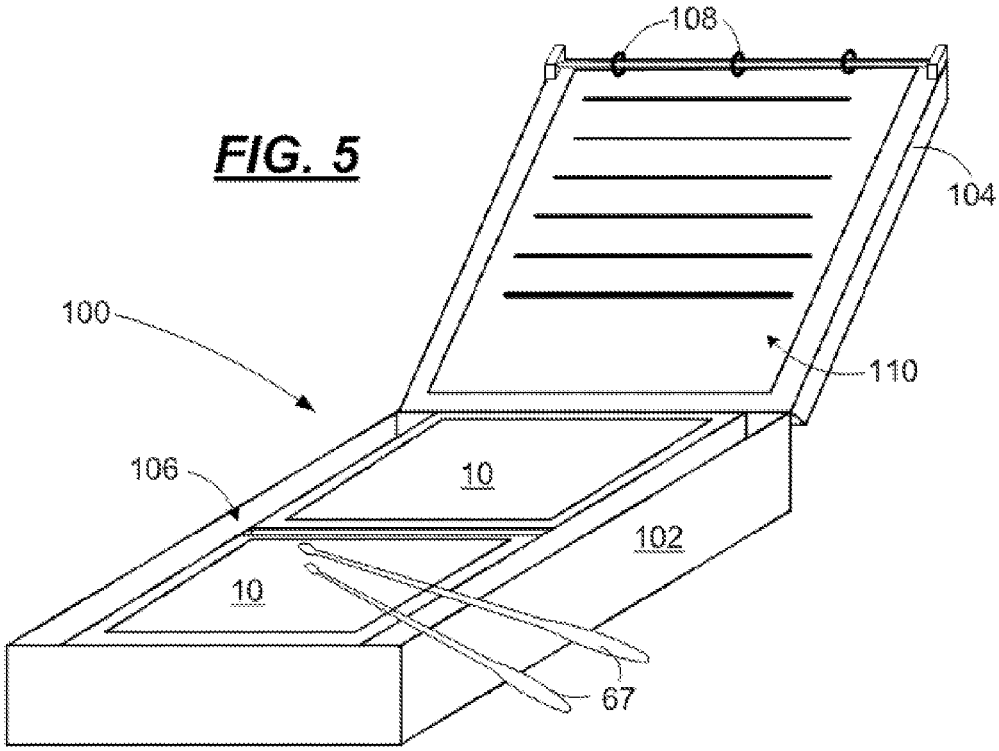
FIG. 5 is a perspective open view, not to scale, of a practice pad kit according to another embodiment of the disclosure.
Figure 6:
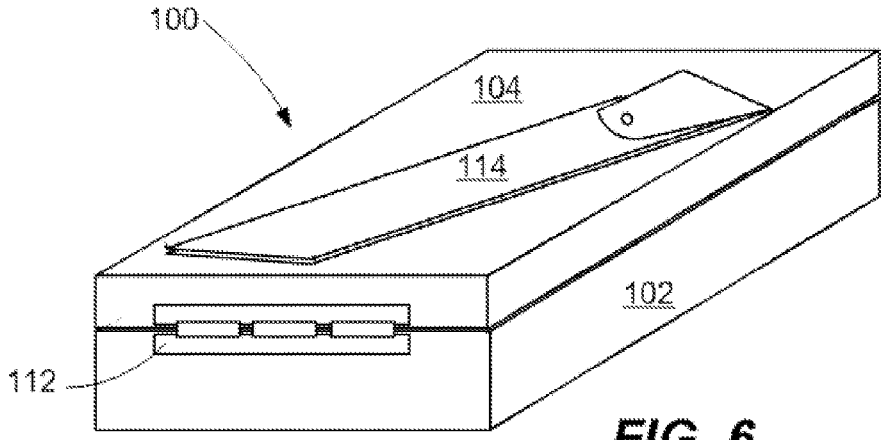
FIG. 6 is a closed perspective view of a practice pad kit according to the disclosure.
Figure 7:
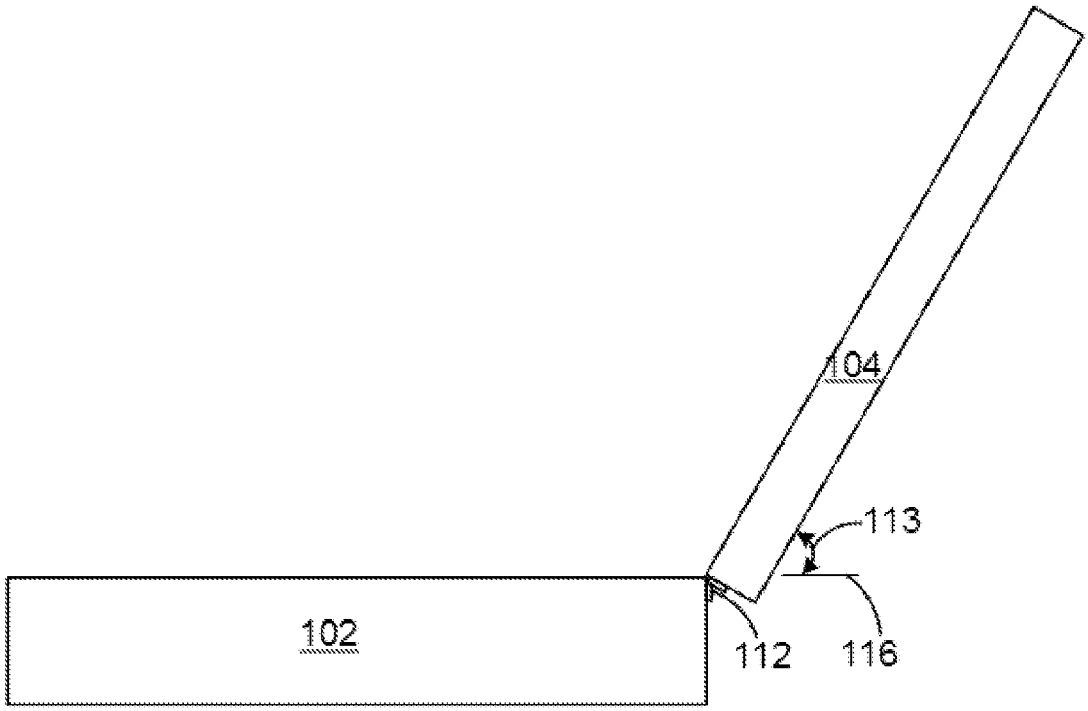
FIG. 7 is a side elevational view, not to scale, of a practice pad kit according to the disclosure.

In an alternate embodiment illustrated in FIGS. 5-7, a percussion instrument practice kit 100 is illustrated. The kit 100 includes one or more percussion instruments, such as the percussion instruments 10 described above disposed in an enclosure base 102 containing a hinged cover 104. A feature of the kit 100 is that the kit 100 also contains a storage area 106 for the percussion sticks 67 and a device 108 for holding and displaying sheet music 110. The device 108 for holding sheet music 110 may selected from any suitable device such as a pad clip, hooks, or as shown, rings 108 that enable the sheet music 110 to be flipped over the cover 104 as the practice session progresses.

The cover 104 is hingedly connected to the enclosure base 102 by hinge 112. The hinge 112 is designed to allow the cover 104 to open to an angle 113 ranging from about 45 to about 85 degrees from a horizontal reference line 116 as shown in FIG. 7. Hence, the cover 104 provides a dual function of protecting the pads 10 and providing a sheet music display surface. Hence the cover is operable over an angle ranging from about 0 to about 145 degrees. As shown, in FIG.

5, the sheet music 110 may be removably attached to the cover 104 by a 3-ring binder mounted substantially parallel with the hinge 112.

When the kit contains two or more percussion instruments 10 each of the percussion instruments 10 may include a different thickness of resilient pad 28, as described above. For example, a practice kit 100 containing two percussion instruments 10, one of the percussions instruments 10 may include a first resilient pad 28 having a thickness of about ¼ inches and a second one of the percussion instruments 10 may have a resilient pad of about ⅛ inch. Each of the resilient pads 28 are attached to the first plate 22 selected from plates 22 of the thicknesses described above. The ¼ inch resilient pad surface provides more bounce and less volume when the instrument 10 is struck. Percussionists typically play on different surfaces in different performances may require a softer attack. Accordingly, the ¼ inch thickness resilient pad 28 may be geared for such performance situations. On the other had, a resilient pad 28 having a ⅛ inch thickness typically gives the user less bounce and more volume. Thus having a combination of pad thicknesses in a single kit 100 provides more practice versatility than with a single percussion instrument 10.

Another feature of the kit 100 is a percussion stick bag 114 that may be attached to the cover 104 on an exterior surface of the kit 100 as shown in FIG. 6. The stick bag 114 enables a user to transport his/her sticks used for rehearsal. As shown, the stick bag 114 may be mounted on the cover 104 diagonally to allow for storage of longer sticks without enlarging the overall size the enclosure 102 and cover 104.

In a further embodiment, outside surfaces of the kit may be upholstered with padding or a foam material. A handle and/or strap may also be attached to the kit for easier transportation from one location to another.

Having described various aspects and exemplary embodiments of the disclosure and several advantages thereof, it will be recognized by those of ordinary skills that the exemplary embodiments are susceptible to various modifications, substitutions and revisions within the spirit and scope of the appended claims.

What is claimed is:

1. An acoustic percussion instrument comprising:

a hollow cylindrical shell having a first end and a second end and an inside cylindrical surface;

a first substantially rigid plate having an outside surface and an inside surface attached adjacent to the first end of the hollow cylindrical shell;

a first resilient pad providing a percussion surface that does not require periodic adjustment is attached adjacent to the outside surface of the first substantially rigid plate, and a raised rim circumscribes the first resilient pad.

2. The percussion instrument of claim 1, wherein the hollow cylindrical shell comprises a laminated wood cylindrical shell having a thickness ranging from about 0.5 to about 1.5 centimeters.

3. The percussion instrument of claim 1, wherein the first resilient pad comprises a synthetic or natural rubber web having a durometer ranging from about 30 to about 50 and a thickness ranging from about 0.1 to about 3 centimeters.

4. The percussion instrument of claim 3, wherein the resilient pad comprises a natural gum rubber.

5. The percussion instrument of claim 1, wherein the substantially rigid plate comprises a plywood plate having a thickness ranging from about 0.3 to about 2.6 centimeters.

6. The percussion instrument of claim 1, wherein the raised rim comprises a material selected from the group consisting of natural and synthetic rubbers, polyvinylchloride, and metal.

7. The percussion instrument of claim 1, further comprising a pressure transducer attached to the inside surface of the first substantially rigid plate.

8. The percussion instrument of claim 1, further comprising a second substantially rigid plate attached adjacent to the second end of the cylindrical shell.

9. The percussion instrument of claim 1, further comprising a snare simulation element attached to the inside surface of the first substantially rigid plate.

10. The percussion instrument of claim 9, wherein the snare simulation element comprises a hollow metal tube having a first surface, a second surface, and one ore more rivets loosely disposed in apertures in the second surface of the tube.

11. A practice drum set comprising one or more percussion instruments of claim 1.

12. A dual headed acoustic percussion instrument comprising:

a hollow cylindrical shell having a first end and a second end and an inside cylindrical surface;

a first substantially rigid plate having an outside surface and an inside surface is attached adjacent to the first end of the hollow cylindrical shell;

a second substantially rigid plate having an inside surface and an outside surface is attached adjacent to the second end of the hollow cylindrical shell, wherein the second substantially rigid plate is thicker than the first substantially rigid plate;

a first resilient pad, providing a first percussion surface that does not require periodic adjustment, is attached adjacent to the outside surface of the first substantially rigid plate;

a second resilient pad, providing a second percussion surface that does not require periodic adjustment, is attached adjacent to the outside surface of the second substantially rigid plate; and a raised resilient rim circumscribes at least one the first and second resilient pads.

13. The percussion instrument of claim 12, wherein the hollow cylindrical shell comprises a laminated wood cylindrical shell having a thickness ranging from about 0.5 to about 1.5 centimeters.

14. The percussion instrument of claim 12, wherein the each of the first and second resilient pads comprises a synthetic or natural rubber web having a durometer ranging from about 30 to about 50 and a thickness ranging from about 0.1 to about 3 centimeters.

15. The percussion instrument of claim 12, wherein each of the first and second resilient pads comprises a natural gum rubber.

16. The percussion instrument of claim 12, wherein each of the first and second substantially rigid plates comprises a plywood plate having a thickness ranging from about 0.3 to about 2.6 centimeters.

17. The percussion instrument of claim 12, wherein the raised rim comprises a material selected from the group consisting of natural and synthetic rubbers, polyvinylchloride, and metal.

18. The percussion instrument of claim 12, further comprising a pressure transducer attached to the inside surface of the first substantially rigid plate.

19. The percussion instrument of claim 12, wherein at least one vent hole is disposed in the cylindrical shell.

20. A percussion instrument practice kit comprising:

a practice pad and sheet music structure comprising at least one practice pad disposed in a cavity of an enclosure and a cover hingedly attached to the enclosure, wherein the practice pad comprises:

a first hollow shell having a first end and a second end and an inside surface;

a first substantially rigid plate having an outside surface and an inside surface attached adjacent to the first end of the first hollow shell;

a first resilient pad providing a percussion surface that does not require periodic adjustment is attached adjacent to the outside surface of the first substantially rigid plate, and wherein the cover comprises a holder for attaching sheet music thereto.

21. The kit of claim 20, further comprising at least a second practice pad disposed in the cavity of the enclosure, wherein the second practice pad comprises:

a second hollow shell having a first end and a second end and an inside surface;

a second substantially rigid plate having an outside surface and an inside surface attached adjacent to the first end of the second hollow shell;

a second resilient pad providing a percussion surface that does not require periodic adjustment is attached adjacent to the outside surface of the second substantially rigid plate.

22. The kit of claim 20, wherein the enclosure further comprises one or more compartments for storing percussion instrument sticks.

23. The kit of claim 20, wherein the cover is operable over an angle ranging from about 0 to about 145 degrees.

24. The kit of claim 20, wherein the hollow shell comprises a laminated wood shell having a thickness ranging from about 0.5 to about 1.5 centimeters.

25. The kit of claim 20, wherein the first resilient pad comprises a synthetic or natural rubber web having a durometer ranging from about 30 to about 50 and a thickness ranging from about 0.1 to about 3 centimeters.

26. The kit of claim 20, wherein the substantially rigid plate comprises a plywood plate having a thickness ranging from about 0.3 to about 2.6 centimeters.

27. The kit of claim 20, further comprising a raised rim circumscribing the first resilient pad, wherein the raised rim comprises a material selected from the group consisting of natural and synthetic rubbers, polyvinylchloride, and metal.

28. The kit of claim 20, further comprising a snare simulation element attached to the inside surface of the first substantially rigid plate.

29. The kit of claim 20, further comprising a stick bag attached to an outside surface of the cover.

* * * * *